United States Patent [19]

Zitzelberger et al.

[11] 4,048,740

[45] Sept. 20, 1977

[54] POST CARD FOLIO

[76] Inventors: Donald J. Zitzelberger; Dorothy A. Zitzelberger, both of 7440 E. 42nd St., Tucson, Ariz. 85730

[21] Appl. No.: 594,443

[22] Filed: July 9, 1975

Related U.S. Application Data

[63] Continuation-in-part of Ser. No. 405,674, Oct. 11, 1973, abandoned.

[51] Int. Cl.[2] ..... G09F 1/10
[52] U.S. Cl. ..... 40/158 R
[58] Field of Search ..... 229/92.8; 40/124.1, 40/158, 61; 283/6, 56

[56] References Cited

U.S. PATENT DOCUMENTS

| | | | |
|---|---|---|---|
| 2,844,901 | 7/1958 | Eisen | 40/158 |
| 2,926,444 | 3/1960 | Atkins | 40/158 R |
| 2,963,809 | 12/1960 | Parker | 40/158 R |
| 3,174,244 | 3/1965 | Walton | 40/158 R |
| 3,884,507 | 5/1975 | Fummel | 40/2 R X |

*Primary Examiner*—Russell R. Kinsey
*Assistant Examiner*—Wenceslao J. Contreras
*Attorney, Agent, or Firm*—Jerome P. Bloom

[57] ABSTRACT

A folio, a plurality of which form a booklet, from outer surfaces of which one may separate a representation of a picture or scene to expose a framed duplicate thereof. In preferred embodiment the separated representation is embodied in a post card format which may be used to send messages to family or friends while the remainder of the folio including the duplicates may be preserved as a permanent album with pertinent notations.

23 Claims, 11 Drawing Figures

POST CARD FOLIO

This invention is a continuation, at least in part, of applicants' application Ser. No. 405,674 filed Oct. 11, 1973, and now abandoned for "POST CARD FOLIO".

BACKGROUND OF THE INVENTION

This invention relates to a unique folio format and construction enabling a highly useful and desirable booklet format. The invention is particularly advantageous where the principle thereof is applied to a booklet related to travel and embodies post cards, and it will be so described by way of illustration. However, it will be obvious from the following description that its application is not so limited and such is not intended.

In the past post cards have been provided in packets, to have scenes pertinent to various geographical areas of travel. The idea has been that in the course of travel people could by such means share their experiences with family and friends. However, in fact, the sending of such items to friends or obtaining them for use as mementoes has been either overlooked due to the sheer limitations of time and experience in the course of travel or due to the fact they are often not geared to create or stimulate interest in their content.

SUMMARY OF THE INVENTION

The present invention has created a format, as applied, by way of example, to the area noted, which lends interest to the preservation of the experiences of travel and simultaneously stimulates a desire to share such experiences with friends and family.

It provides, in preferred embodiment, an album type booklet the folio portions of which are distinguished by a simple but unique form. In the illustrative examples herein described a folio composite of the invention basically includes a pair of leaf or sheet segments positioned to have one superposed over the other, means providing a picture or scene in connection with the outermost surface of at least one of said pair of leaf or sheet segments, said picture or scene being outwardly displayed and having in backing and underlying relation thereto a similar picture or scene forming a part of said folio composite, and said outwardly displayed picture or scene having a releasable mount in connection with said folio composite, which is formed to provide a frame for said similar picture or scene on the release therefrom of said outwardly displayed picture or scene. The outer surfaces of said folio composite are designed to firmly hold but to permit the ready separation of the pictures and/or scenes in connection therewith. The separation, as noted, is designed to provide an opening within which is framed a permanent duplicate of the separated picture or scene. In one embodiment the duplicate of a separated picture or scene is provided on means enclosed interiorly of outer surface portions of the folio. In a preferred embodiment the duplicates are imprinted on innermost surface portions of the sheet segments forming a folio in immediate backing relation to the adjacent sheet segment which embodies in connection therewith the picture or scene duplicated.

In the preferred application described the reverse sides of the pictures and/or scenes which may be separated have a post card format enabling their use to send the same to a particular friend or relative with comments, while both the act and the travel experience involved, as represented by the particular picture or scene, may be preserved in the folio composite. It will be seen that the outer surfaces of the folio are of a nature to permit notes of a particular act referenced to the actual view of the picture or scene recorded. As will be evident, a preferred embodiment of the invention folios may embody a plurality of post cards embellished with pictures or scenes which may be separated from the folio to leave a framed duplicate of each. Moreover, the invention contemplates that one or more of the folio composites thereof may form a booklet or book which may be preserved as a permanent album of related experiences.

It will be obvious from the illustrative applications herein described that the invention concept need not be limited to a post card format of the separable sections of the folio.

A primary object of the invention is to provide a folio which is economical to fabricate, efficient and satisfactory in use, and adaptable to a wide variety of applications.

A further object of the invention is to provide a unique folio enabling a booklet which can simultaneously serve as an album and a means for sharing the content thereof with others.

Another object of the invention is to provide a unique folio the composite of which provides separable portions while enabling the preservation of duplicate portions, and a folio which particularly enables the separable portions to have a post card format the use of which leaves a reminder of the act as well as the experience of having actually and personally viewed the subject matter of the post card.

An additional object of the invention is to provide an improved folio possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein are shown some but not necessarily the only forms of embodiment of the invention;

Figure 8:
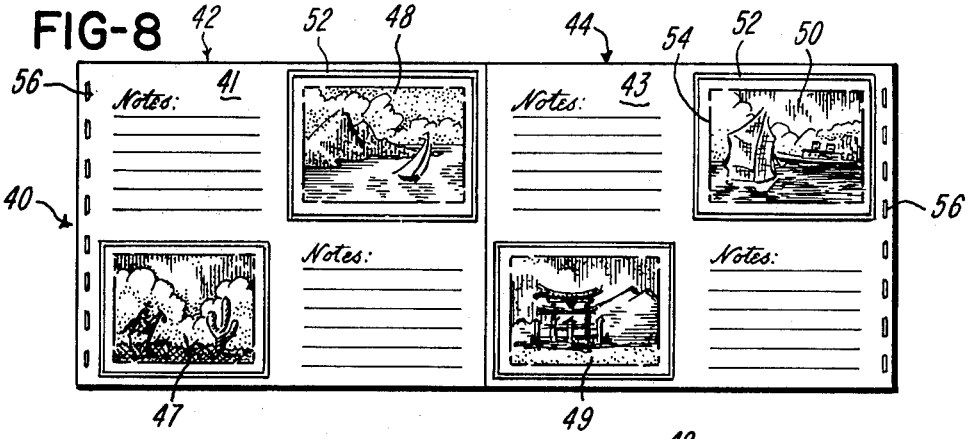
Figure 9:
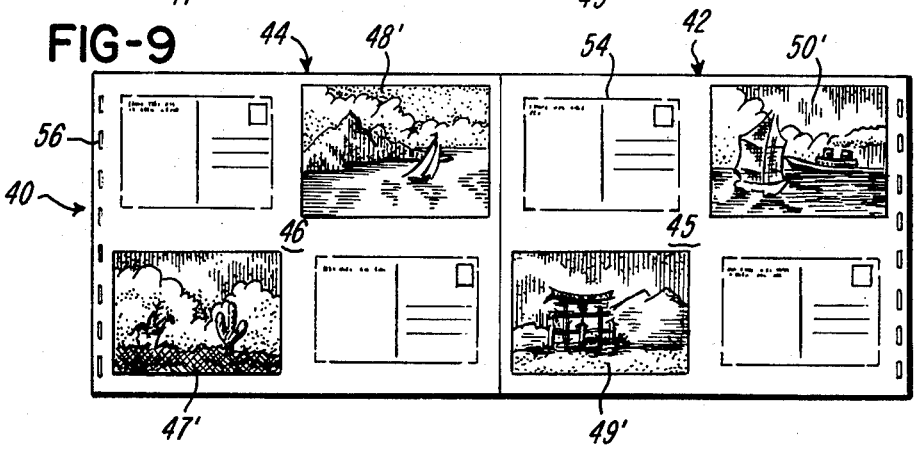
Figure 10:
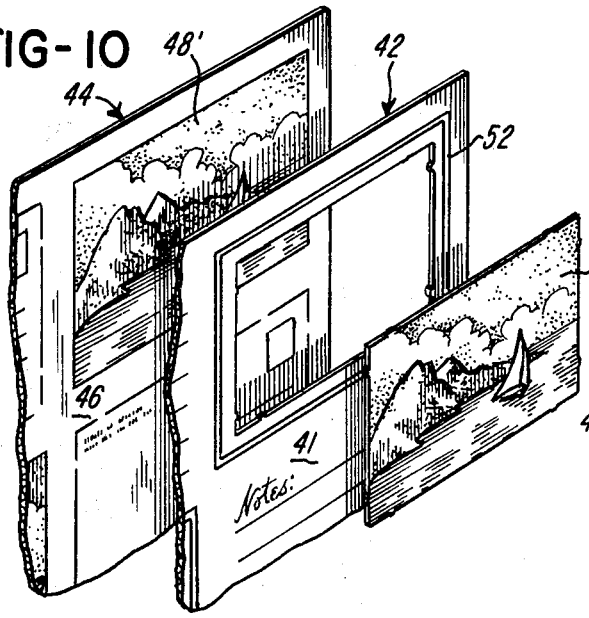
Figure 11:
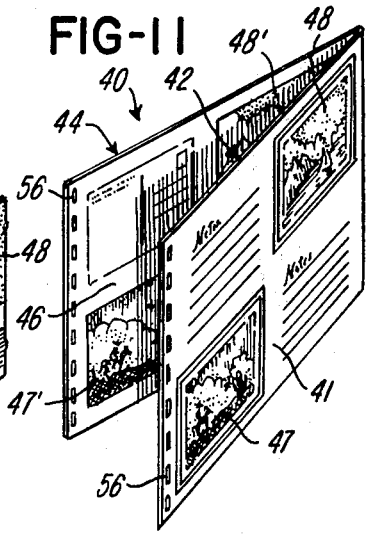

FIG. 8 of the drawings illustrates a further preferred embodiment of the invention consisting of a pair of leaf or sheet sections of a folio composite formed by folding one-half of a single sheet on the other, the view illustrated representing a plan view of the outer surface portions of the respective sections one of which is superposed over the other to form the folio;

FIG. 9 is a plan view of the inner surface portions of the folio composite of FIG. 8, such inner surfaces being exposed in a side-by-side relation; and FIG. 10 is an exploded view illustrating the invention folio further, as is FIG. 11.

Like parts are indicated by similar characters of reference throughout the several views.

With reference to FIGS. 1–4 of the drawings one preferred folio 10 in accordance with the invention includes a single sheet of paper or other imprintable material folded into three sections 12, 14 and 16. In this instance the inner portion of the folio is provided by one end section 12 which in assembly is folded to interleaf between the sections 14 and 16 which are folded thereover.

Depending on the size of the original sheet, and thereby the size of the respective folded sections, the surfaces of sections 14 and 16 which are to be outermost are imprinted with one or more pictures and/or scenes, here schematically illustrated to comprise, for simplicity of description, those designated by the numerals 18, 20, 22 and 24. While the scenes 18 and 20 are not specifically shown, their location should be clear with reference to FIGS. 1 and 5 wherein the respective backs of the pictures are identified by their designated reference numerals. As will be seen the pictures or scenes 18 and 20 are appropriately spaced on the outer surfaces of section 14 while those identified as 22 and 24 are similarly located on section 16 to lie in clearly defined areas. Moreover the surface area peripherally of each thereof has superposed thereon an imprint simulating a picture frame 26. The sheet sections 14 and 16 are die cut at 28 in areas thereof bounding each imprinted picture or scene, within the border of its frame 26. In this manner, by slits, perforations or similar cuts, means are provided whereby, as and when required, the portions of the sheet sections 14 and 16 bearing the pictures or scenes may be readily separated.

The reverse side of each of these separable portions of the sheet sections 14 and 16 are in this instance imprinted so that when separated they can be used as a post card.

The sheet section 12 is imprinted on its respective faces 30 and 32 with pictures and/or scenes 18', 20', 22' and 24' which are duplicates of the imprints 18, 20, 22 and 24 respectively. While only the pictures 22' and 24' are specifically illustrated on the face 30 in the FIG. 1, it will be self-evident that the pictures 18' and 20' will be imprinted on the face 32 so that in the folding the folio they will be in immediate backing relation to the separable portions of the sheet section 14 bearing on the outer surface thereof the pictures respectively identified as 18 and 20. Thus, the imprints 18'14 24° are so located that when the sheet section 12 is disposed within the sheet sections 14 and 16, the imprint 18' will be in direct backing relation to and aligned with the imprint 18, and the imprints 20', 22' and 24' will position similarly with respect to the imprints 20, 22 and 24 respectively. As seen aligning pictures or scenes are designated by similar numerals.

The surfaces of the sheet portions 14 and 16 bounding the imprints outermost in a finished folio will be of a nature to be receptive to marking or writing.

With a folio comprised of the parts described and the imprints of a nature having a common reference, such as to a geographic area, a plurality thereof bound into a booklet form may feature the most memorable areas visited or to be visited in the course of travel. To enable the booklet form, common edges of the folio portions are perforated at 36 to form apertures, slits or other openings conventionally necessary for binding folios into a book or booklet. One having such a booklet can, upon seeing the actual origin of the picture or scene of an imprint, mark the date, impressions and other data on the outer surface portions of the sheet sections 14 and 16 adjacent the pertinent imprint. Simultaneously a stimulation of a need or desire to share with others can be satisfied by manually separating the pertinent imprint secured at the outer surface of the folio and using it as a post card. This leaves the corresponding duplicate imprint on the interior sheet section 12 in the opening left by the separation of the outer imprint and framed by the imprinted simulation of a frame 26. The whole provides a unique facility of permanent interest and facilitating a sharing with friends and family who are not present.

Figure 1:
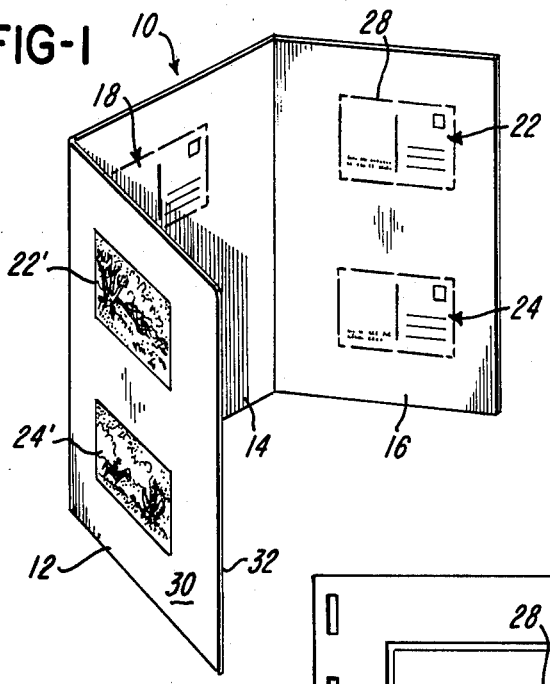
FIG. 1 is a perspective exploded view of one form of folio per the invention.
Figure 2:
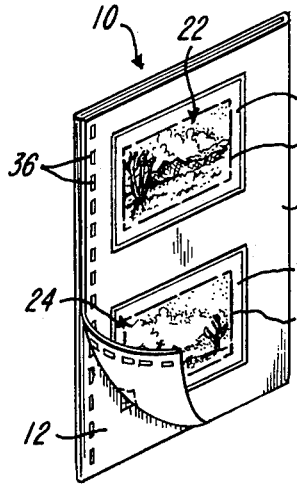
FIG. 2 shows the folio of FIG. 1 in its folded form as it forms a unit segment of a booklet and illustrates the separability of sections at its outer surface.
Figure 3:
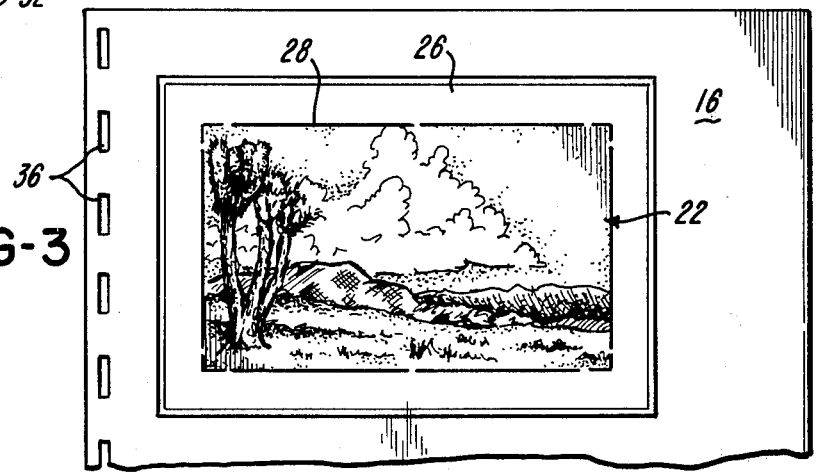
FIG. 3 is an enlarged view of an outer surface portion of the folio of FIG. 1.
Figure 4:
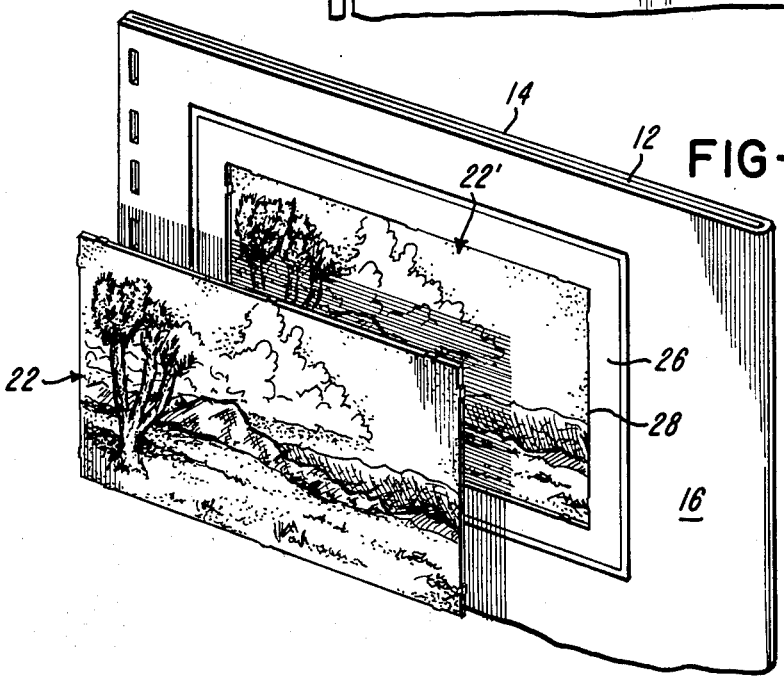
FIG. 4 shows a view such as FIG. 3 wherein a separable portion at the outer surface has been removed.
Figure 5:
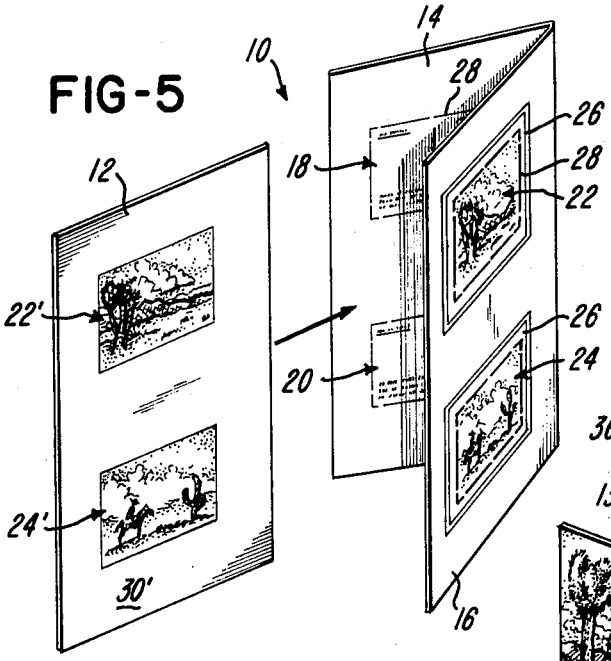
FIGS. 5 and 6 show modifications of the folio of FIG. 1.

Reference is made to FIG. 5 of the drawings which illustrates the fact that the inner sheet section 12 may be separate in the first instance and suitably secured within the folio portion provided by sections 14 and 16. For that matter the folio could be formed of layered separate sheets formed and imprinted as and serving the respective purposes of the sheet sections 12, 14 and 16, and still retain basics of the concept of the present invention.

Figure 6:
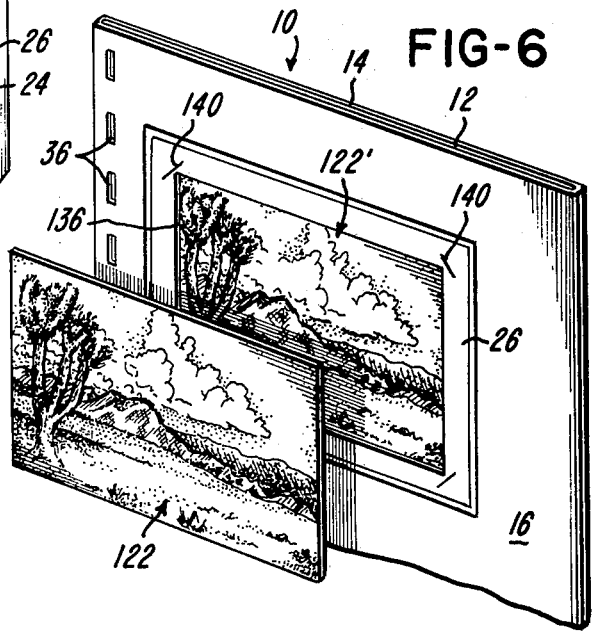

FIG. 6 illustrates a further but less desirable form of embodiment of the invention concept. In this case the separable portions of the sections 14 and 16 bearing the pictures or scenes may be in the first instance be printed on separate sheet segments 118, 120, 122 and 124, sized to be slightly larger than openings 136 formed by removal of portions of the sheet sections 14 and 16 in the first instance. The openings 136 would then have frames 26 thereabout which bound imprints on the inner or interleafed section 12 of the folio corresponding to the pictures or scenes of the imprints 118, 120, 122 and 124. In this case the sheet sections 14 and 16 are provided with slits or other means 140 for a fixed but releasable attachment of the imprinted segments 118, 120, 122 and 124.

The folio as modified per FIG. 6 is not preferred, but, preserving the other basic features of the folio of FIGS. 1–4, it can serve similar purpose.

Figure 7:
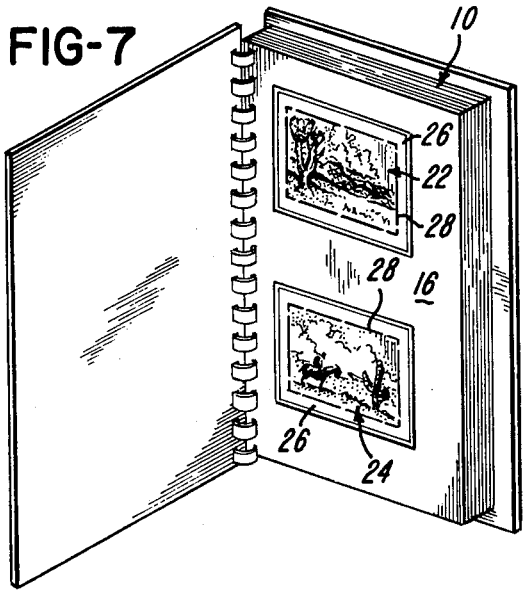
FIG. 7 illustrates the invention folio in a booklet embodiment thereof.

FIG. 7 shows the invention folio in an illustrative booklet form.

The folio of the invention is here described as a unique travel album and post card facility and in such application proves to lend the album and post card art a significant concept expanding the use and benefits thereof. Other applications will likewise profit.

FIGS. 8 through 10 of the drawings show another preferred embodiment of the invention. The folio composite 40 here illustrated is again basically comprised of a single sheet of paper or other imprintable material folded on itself to form it into two equal segments constituting sheet or leaf sections 42 and 44 one of which is positioned over the other. As so positioned, the remote faces of the folio are defined by the outermost face 41 of the section 42 and the outermost face 43 of the section 44. The respectively facing and immediately adjacent inner surfaces of the sections 42 and 44 are respectively identified by the numerals 45 and 46.

Imprinted on the outermost face 41 of the section 42 are two pictures or scenes respectively identified by the numerals 47 and 48. The outermost face 43 of the sheet or leaf section 44 similarly imprinted thereon two pictures or scenes respectively identified by the numerals 49 and 50. Particular attention should be paid to the face that the pictures 47, 48, 49 and 50 are so positioned on the outermost and remote faces of the folio that if the pictures on one face were projected directly through the folio composite to the other they would be fully clear of the others.

Positioned on the inner face 46 of the folio section 44 are the imprints of two pictures respectively identified by the numerals 47' and 48'. The picture or scene designated as 47' is an exact duplicate of the picture or scene 47 and, with the folio sections superposed, positions in directly aligned and immediate backing relation to that segment of the folio section 42 bearing the picture 47. As will be obvious, the picture or scene 48' is similarly disposed in a directly aligned immediate backing relation to the segment of the folio section 42 bearing the picture 48. Also, the picture 48' is an exact reproduction or duplicate of the picture 48. The inner surface 45 of the folio section 42 similarly bears pictures or scenes 49' and 50' which respectively are duplicates of the pictures or scenes 49 and 50. Also, the picture or scene 49' is in immediate backing relation to and in directly aligned relation with the segment of the folio section 44 bearing the picture or scene 49. The picture or scene 50' is similarly positioned in reference to the segment of the folio section 44 bearing on the outermost face thereof the picture 50.

Thus, the folio composite of this last described embodiment of the invention is comprised of two sections one of which is positioned directly over the other and each picture on an outer face thereof has the segment of the folio on which it is imprinted immediately backed by a duplicate picture on the adjacent inner face of the other section of the folio composite.

As in the case of the first described embodiment of the invention, each picture or scene on an outermost surface of the folio segment is rimmed by an imprint simulating a picture frame 52. Moreover, each of the folio sections 42 and 44 are die cut at 54 in the areas thereof bounding each picture or scene imprinted on its outer surface, within the border of its frame 52. Thus the boundary of each imprinted picture or scene on the outer surface of the folio composite is defined by slits, perforations or similar cuts. This enables that each segment of a folio section on the outermost surface of which is imprinted a picture or scene may be readily separated from the folio section or scene may be readily separated from the folio section in which it is embodied. The reverse side of the separable segments are imprinted so that when separated they can be used as a post card. Also on the outer surface of the folio, in an adjacent relation to each picture, is an area designated for notes or comments referenced to related experiences or thoughts. Of course, when a picture is separated, the duplicate thereof on the inner surface of the underlying folio section will appear in its frame 52. It should be noted that the areas of the outer surfaces of the folio sections designated for notes or comments are located on the outermost sides of the folio segments the inner surfaces of which bear the aforementioned duplicate pictures or scenes.

As in the case of the embodiment first described, common edge portions of the folio sections 42 and 44 remote from the fold in the original sheet from which they are formed are provided with such apertures, slits or other openings 56 as may be conventionally necessary for binding the folio composites into a booklet or book such as demonstrated in FIG. 7, with reference to the embodiments of FIGS. 1 through 6 of the drawings.

Of course, the concept demonstrated in FIG. 6 can be equally employed with reference to the embodiment of the invention shown in FIGS. 8 through 11.

From the foregoing it may be seen that the invention provides, in a unique fashion, more than a mere booklet from which picture post cards or tickets can be successively torn. It provides a meaningful folio or album enabling a person to share experiences with someone else and to retain permanent evidence of the shared experiences. The significant impact of this concept on the post card and album industry should be self-evident.

It should be also obvious, from the foreoing, that the invention may be similarly employed for any application where it is desirable to have permanent duplicates of exhibits which are to be delivered to another party.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A folio, including overlying and underlying pictorial representations on respective outer and inner sheet portions, said inner sheet portion having the character of an insert provided with permanent pictorial representations on each of its opposite faces, said outer sheet portion being in two parts with each part being applied to a respective face of said insert and each having at least one detachable pictorial representation thereon to superpose over respective permanent representations on said insert, the overlying pictorial representations facing outwardly for visible selection and the underlying pictorial representations facing in the same direction to be exposed by removal of respective overlying pictorial representations, said latter representations being detachably comprised in respective parts of said outer sheet portion and in a detached form having separate utility, said underlying pictorial representations being integrated into said inner sheet portion to remain as a permanent part of the folio and providing a record of detached representations.

2. A folio according to claim 1, wherein said insert inner sheet portion and said two-part outer sheet portion are connected to define a folder, said inner sheet portion being a terminal part of the folder adapted to be folded into a position between the two parts of the outer sheet portion, said two parts being in a connected contiguous relation with one thereof forming another terminal part of the folder and said two parts being adapted to be closed upon said insert inner sheet portion.

3. A folio according to claim 2, wherein the pictorial representations on parts of said outer sheet portion are post cards, said outer sheet portion having openings accommodating said post cards, reverse sides of said cards being exposed in an open position of said folder.

4. A folio according to claim 2, wherein inner and outer sheet portions are marginally apertured with marginal apertures aligning in a closed position of the folder and forming a part of means to bind plural superposing folders into booklet form, individual closed folders forming leaves of the booklet.

5. A folio, including overlying and underlying pictorial representations on respective outer and inner sheet portions, said outer sheet portion forming part of a single sheet which is folded on itself to provide a two-part outer sheet portion with overlying pictorial representations comprised in each thereof, said inner sheet portion having the character of an insert to be placed between the two parts of the outer sheet portion and having permanent pictorial representations on opposite faces thereof to underlie detachable pictorial representations as comprised in said outer sheet portion, the overlying pictorial representations facing outwardly for visible selection and the underlying pictorial representations facing in the same direction to be exposed by removal of the overlying pictorial representations, said latter representations being detachably comprised in respective parts of said outer sheet portion and in a detached form having separate utility, said underlying pictorial representations being integrated into said inner sheet portion to remain as a permanent part of the folio and providing a record of detached representations.

6. A folio composite including a pair of sheet sections positioned to have one superposed over the other, means providing a picture or scene in connection with the outermost surface of at least one of said pair of sheet sections, said picture or scene being outwardly displayed and having in backing and underlying relation thereto a similar picture or scene forming a part of said folio composite, and said outwardly displayed picture or scene having a releasable mount in connection with said folio composite, the latter of which is formed to provide a frame for said similar picture or scene on the release therefrom of said outwardly displayed picture or scene, marginal edges of the sheet sections embodying means facilitating interconnection thereof and the connection of a plurality of folio composites into a booklet form.

7. A folio composite as in claim 6 wherein both said superposed sheet sections respectively and releasably mount means providing in connection therewith an outwardly displayed picture or scene having in underlying relation thereto a similar picture or scene exposed and framed by said composite on the release of the overlying said outwardly displayed picture or scene.

8. A folio composite as in claim 6 wherein said backing and underlying picture or scene is integrated with a sheet section of said composite which is in an immediate backing relation to said sheet section mounting said means providing the releasable picture or scene in connection with its outer surface.

9. A folio composite as in claim 6 wherein said backing picture or scene is comprised in a third section of said folio composite which is interposed between said pair of sections.

10. A folio composite as in claim 6 wherein said similar picture is applied to the surface of one of said sections which is immediately adjacent the other of said sections.

11. A folio composite as in claim 6 wherein said pair of sections are part of an integral sheet or leaf structure one portion of which is folded over the other to produce said composite.

12. A folio composite as in claim 6 wherein the immediately adjacent surfaces of said sections each embody, in relatively offset portions, at least one picture or scene forming a duplicate of means providing an outwardly displayed picture or scene in releasable connection with the other of said sections.

13. A folio composite as in claim 6 characterized by the outermost surfaces of said sheet sections bearing a plurality of means providing a picture or scene in connection therewith and said pictures or scenes being characterized by being offset clear of the other pictures or scenes and the adjacent inner surfaces of said sheet sections having on at least one thereof a plurality of pictures or scenes each of which is a duplicate of one of the outwardly displayed pictures or scenes and in backing relation to the segment of the sheet section which bears the duplicated picture or scene.

14. A folio, including a sheet or imprintable material having a fold line defining to either side thereof first and second sheet sections, said sheet being foldable upon itself about said fold line and said sheet sections each presenting thereby an innermost and an outermost face, each sheet section having at least one separable portion to removal of which leaves a framed opening in the sheet section and each sheet section having further at least one imprint on the innermost face thereof in offset relation to said separable portion therein, an imprint on the first sheet section positioning to be visible through a framed opening in the second sheet section and an imprint on the second sheet section positioning to be visible through a framed opening in the first sheet section.

15. A folio according to claim 14, characterized by means interconnecting free marginal edges of said sheet sections and interconnecting superposed folios as leaves of a book.

16. A folio, including a sheet of imprintable material having a fold line define first and second sheet sections, said sheet being foldable upon itself about said fold line and, in the folded condition thereof, establishing said sheet sections in a relatively superposed relation under which condition each said sheet section has an innermost face and an outermost face, each said sheet section having at least one separable portion the removal of which leaves an opening in the sheet section, said separable portions being each characterized by a pictorial representation on the outermost surface thereof, and means in a backing relation to each of said superposed sheet sections including pictorial representations each positioning to be visible through one of said openings, left by removal of a separable portion in the superposed sheet section, to be framed thereby and to present within said frame a pictorial representation which is identical to that presented on the separable portion which has been removed from said superposed sheet section.

17. A folio, including a sheet of imprintable material having a fold line defining first and second sheet sections, said sheet being foldable upon itself about said fold line and in the folded condition thereof providing that each said sheet section has an innermost face and an outermost face, each said sheet section having at least one separable portion the removal of which leaves a framed opening in the sheet section, and imprint means in a backing relation to the innermost faces of both sheet sections including imprints respectively positioning to be visible through the respective framed openings therein, said imprint means including an insert sheet section between said first and second sheet sections having imprints on reverse sides thereof.

18. A folio including a sheet of imprintable material having a fold line defining first and second sheet sections, said sheet being foldable upon itself about said fold line and in the folded condition thereof providing that each said sheet section has an innermost face and an outermost face, each said sheet section having at least one separable portion the removal of which leaves a framed opening in the sheet section, and imprint means in a backing relation to the innermost faces of both sheet sections including imprints respectively positioning to be visible through the respective framed openings therein, said imprint means taking the form of imprints on the innermost faces of said first and second sheet sections in an offset relation to separable portions of said first and second sheet sections.

19. A folio composite comprising a pair of sheet sections positioned to have one superposed over the other, means providing a picture or scene in connection with an outermost surface of each of said sheet sections, said pictures or scenes being displayed outwardly of said sheet sections, on remote surfaces thereof, and being separable therefrom, and each having in backing and underlying relation thereto a similar picture or scene forming part of said folio composite, each sheet section providing a frame for said separable picture or scene and, on removal of said separable picture or scene, a frame surrounding the underlying similar picture or scene.

20. A folio composite as in claim 19 wherein an outermost surface of each of said pair of sheet sections has means providing a plurality of separable pictures or scenes in connection therewith and displayed on the outwardly disposed surface thereof and there is provided in backing, underlying relation to each said separable picture or scene a similar picture or scene which is incorporated in connection with the adjacent inner surface of the other of said superposed sheet sections.

21. A folio composite as in claim 19 wherein said underlying picture or scene is provided on a further sheet section interposed between said pair thereof.

22. A folio composite as in claim 19 wherein said underlying picture or scene is embodied on the surface of said sheet section which immediately underlies said one sheet section.

23. A folio composite as in claim 19 wherein there are several of said sheet sections superposed and paired to have in connection with similarly facing surfaces of paired sections thereof in one instance means defining a separable picture or scene and in the other a permanently embodied similar picture or scene which underlies the separable picture or scene and positions to be framed within a frame provided about the separable picture or scene.

* * * * *

UNITED STATES PATENT AND TRADEMARK OFFICE

CERTIFICATE OF CORRECTION

PATENT NO. : 4,048,740

DATED : September 20, 1977

INVENTOR(S) : Donald J. Zitzelberger; Dorothy A. Zitzelberger

It is certified that error appears in the above-identified patent and that said Letters Patent are hereby corrected as shown below:

Col. 3, line 46, -- of -- is inserted following "folding" --;

line 50, "18' 14 24°" is amended to read -- 18'-24' --.

Col. 4, line 65, "has" is inserted preceding -- similarly --;

line 67, "face" is amended to read -- fact --.

Col. 5, delete line 45.

Col. 6, line 12, "foreoing" is amended to read -- foregoing --.

Col. 8, line 13 (Claim 13 line 5) -- and -- is inserted following "offset";

line 20, (Claim 14, line 1) "or" is amended to read -- of --; (cont.)

UNITED STATES PATENT AND TRADEMARK OFFICE

CERTIFICATE OF CORRECTION

PATENT NO. : 4,048,740

DATED : September 20, 1977

INVENTOR(S) : Donald J. Zitzelberger; Dorothy A. Zitzelberger

It is certified that error appears in the above-identified patent and that said Letters Patent are hereby corrected as shown below:

Col. 8, line 26, (Claim 14, line 7) "to" is amended to read -- the --;

line 39, (Claim 16, line 2) "define" is amended to read -- defining --.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*